US005113850A

United States Patent [19]

Larremore et al.

[11] Patent Number: 5,113,850

[45] Date of Patent: May 19, 1992

[54] MASSAGING SHOE APPARATUS

[76] Inventors: Derek P. P. Larremore; Rhoda A. Larremore, both of 630 N. Sartillion, Ajo, Ariz. 85321

[21] Appl. No.: 688,978

[22] Filed: Apr. 22, 1991

[51] Int. Cl.[5] ..... A61H 1/00

[52] U.S. Cl. ..... 128/32; 128/25 B; 128/62 R

[58] Field of Search ..... 128/25 B, 581, 582, 128/594; 36/7.5, 8.1, 43

[56] References Cited

U.S. PATENT DOCUMENTS

| | | | |
|---|---|---|---|
| 1,145,534 | 7/1915 | Wetmore | 128/594 |
| 3,731,674 | 5/1973 | Parvin | 128/582 |
| 4,599,997 | 7/1986 | Bucher | 128/36 |
| 4,735,195 | 4/1988 | Glum | 128/25 B |
| 4,802,463 | 2/1989 | Rojas | 128/582 |
| 4,823,799 | 4/1989 | Robbins | 128/582 |
| 4,896,441 | 1/1990 | Galasso | 128/581 |

*Primary Examiner*—Robert A. Hafer
*Assistant Examiner*—David J. Kenealy
*Attorney, Agent, or Firm*—Leon Gilden

[57] ABSTRACT

An apparatus including a shoe upper mounted coextensively over a shoe sole, with the shoe sole including a switch member to actuate selectively a vibratory plate in cooperation with a battery housing mounted to the shoe upper at a rear end thereof. The vibratory plate includes a replaceable polymeric sole pad mounted coextensively thereover of a plurality of pads, to include the pads formed with projections and various degrees of stiffening agents directed through the pad to direct various levels of vibratory energy to an individual's foot.

1 Claim, 4 Drawing Sheets

MASSAGING SHOE APPARATUS

BACKGROUND OF THE INVENTION

1. Field of the Invention

The field of invention relates to shoe apparatus, and more particularly pertains to a new and improved massaging shoe apparatus wherein the same is constructed to direct soothing and vibratory energy to an individual's foot for enhanced circulatory and soothing flow therethrough.

2. Description of the Prior Art

Vibration of an individual's foot for its soothing and therapeutic effect is known in the prior art. Such devices have typically been of elaborate and expensive construction to direct vibratory energy to an individual's foot. The instant invention attempts to overcome deficiencies of the prior art by providing a compact organization that is selectively operative for its therapeutic effect to an individual's foot and is compactly mounted and transported by the individual when secured to the foot.

Examples of prior art vibratory type devices may be found in U.S. Pat. No. 4,735,195 to Blum, et al. wherein an electronic device may be worn by a user while moving about, wherein the device monitors ankle motion to encourage joint motion and a muscular activity.

U.S. Pat. No. 3,757,774 to Hatuno sets forth a sandal construction formed of projections to facilitate circulation of blood during its use by an individual.

U.S. Pat. No. 3,888,242 to Harris, et al. sets forth a massaging boot formed of a series of inwardly flexible tips supplied with gaseous pressure for use by an individual.

U.S. Pat. No. 4,807,602 to Scarborough, et al. sets forth a foot massager formed with a floor for receiving a foot thereon.

As such, it may be appreciated that there continues to be a need for a new and improved massaging shoe apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shoe apparatus now present in the prior art, the present invention provides a massaging shoe apparatus Wherein the same provides for a compact shoe member utilizing a selfcontained vibratory organization with replaceable circulation enhancing pads mounted therewithin. As such, the general purpose of the present invention, which will be described subsequently in greater detail, is to provide a new and improved massaging shoe apparatus Which has all the advantages of the prior art shoe apparatus and none of the disadvantages.

To attain this, the present invention provides an apparatus including a shoe upper mounted coextensively over a shoe sole, with the shoe sole including a switch member to actuate selectively a vibratory plate in cooperation with a battery housing mounted to the shoe upper at a rear end thereof. The vibratory plate includes a replaceable polymeric sole pad mounted coextensively thereover of a plurality of pads, to include the pads formed with projections and various degrees of stiffening agents directed through the pad to direct various levels of vibratory energy to an individual's foot.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art Who are not familiar with patent or legal terms or phraseology, to determine quickly from a cursory inspection the nature and essence of the technical disclosure of the application The abstract is neither intended to define the invention of the application, which is measured by the claims, nor is it intended to be limiting as to the scope of the invention in any way.

It is therefore an object of the present invention to provide a new and improved massaging shoe apparatus Which has all the advantages of the prior art shoe apparatus and none of the disadvantages.

It is another object of the present invention to provide a new and improved massaging shoe apparatus Which may be easily and efficiently manufactured and marketed.

It is a further object of the present invention to provide a new and improved massaging shoe apparatus which is of a durable and reliable construction.

An even further object of the present invention is to provide a new and improved massaging shoe apparatus which is susceptible of a low cost of manufacture with regard to both materials and labor, and which accordingly is then susceptible of low prices of sale to the consuming public, thereby making such massaging shoe apparatus economically available to the buying public.

Still yet another object of the present invention is to provide a new and improved massaging shoe apparatus which provides in the apparatuses and methods of the prior art some of the advantages thereof, while simultaneously overcoming some of the disadvantages normally associated therewith.

Still another object of the present invention is to provide a new and improved massaging shoe apparatus wherein the same utilizes sole members formed with various projections and reinforcement to be directed therethrough to vary massaging effect during vibratory use of the shoe by an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will he better understood and objects other than those set forth above will become apparent when consideration is given to the following detailed description thereof. Such description makes reference to the annexed drawings wherein.

DESCRIPTION OF THE PREFERRED EMBODIMENT

Figure 1:
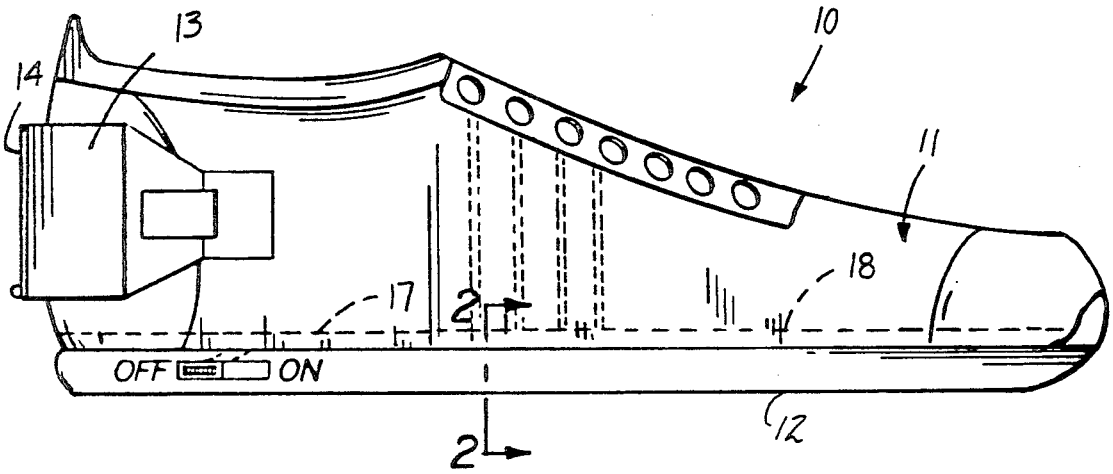
FIG. 1 is an orthographic side view, taken in elevation, of the instant invention.
Figure 2:
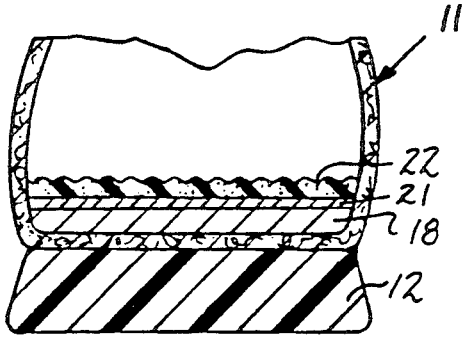
FIG. 2 is an orthographic view, taken along the lines 2—2 of FIG. 1 in the direction indicated by the arrows.
Figure 3:
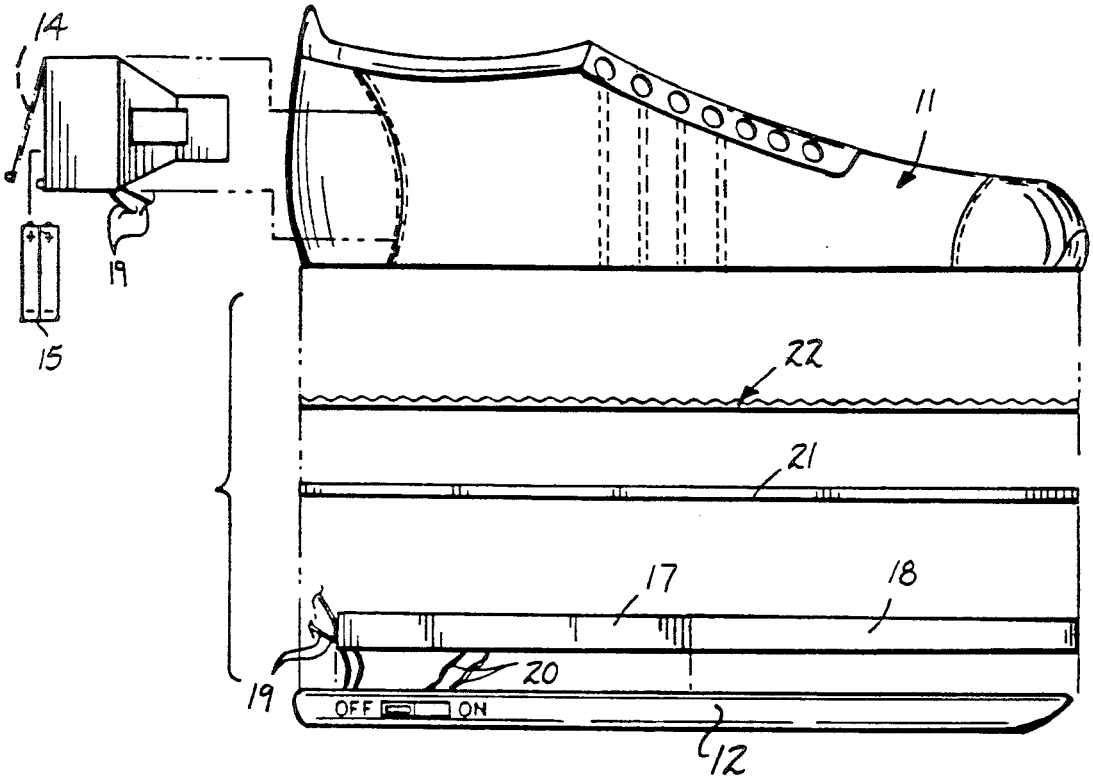
FIG. 3 is an orthographic exploded side view of the instant invention.
Figure 4:
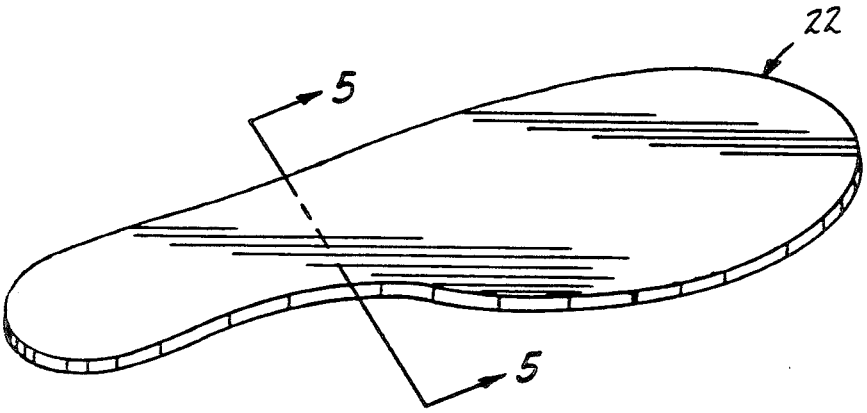
FIG. 4 is an isometric illustration of a typical sole insert utilized by the instant invention.
Figure 5:
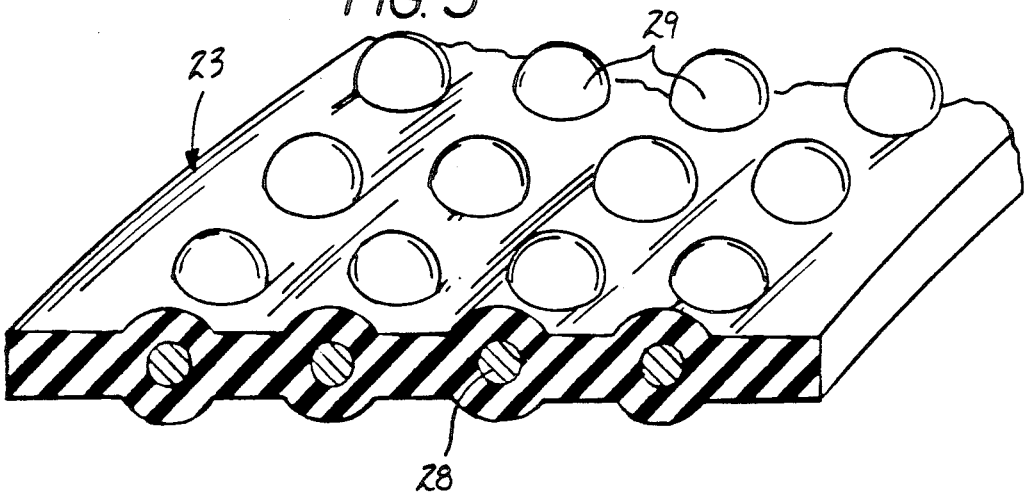
FIG. 5 is an orthographic view, taken along the lines 5—5 of FIG. 4 in the direction indicated by the arrows.
Figure 6:
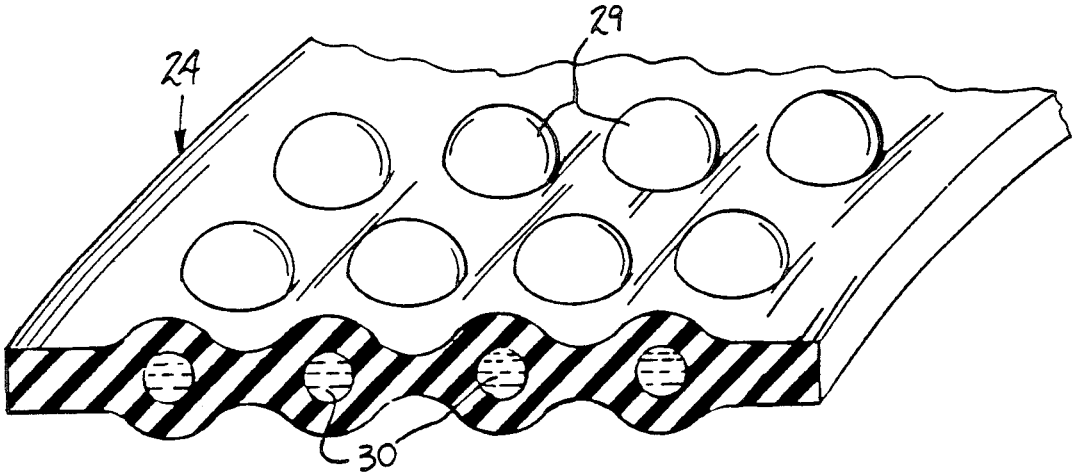
FIGS. 6-9 are each isometric illustrations of various shoe pad insert constructions utilized by the instant invention.
Figure 7:
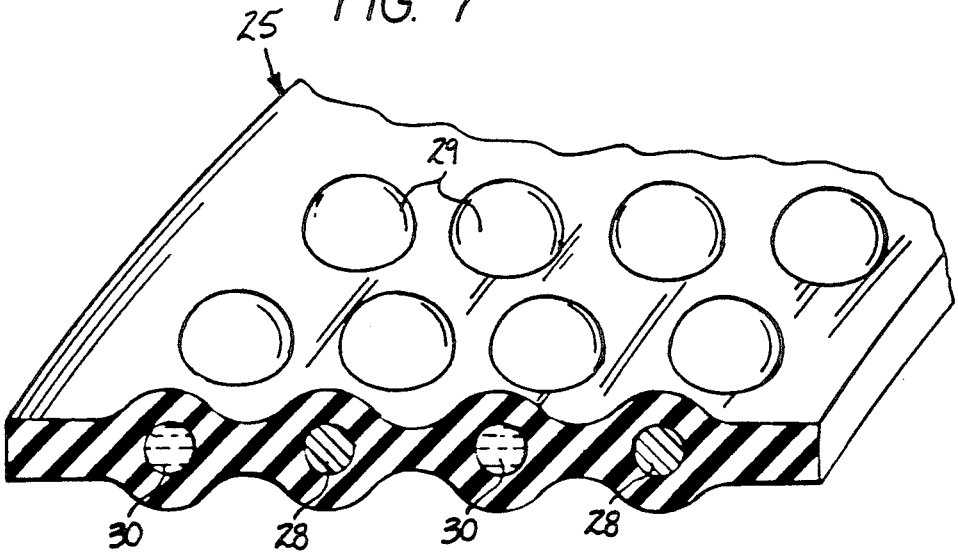

With reference now to the drawings, and in particular to FIGS. 1 to 9 thereof, a new and improved massaging shoe apparatus embodying the principles and concepts of the present invention and generally designated by the reference numeral 10 will be described.

More specifically, the massaging shoe apparatus 10 of the instant invention essentially comprises a shoe upper positioned above and coextensively mounted to an upper terminal perimeter end of a shoe sole 12. The shoe sole 12 is formed of a flexible memory retentent polymeric material. A battery housing 13 is mounted to the shoe upper 11 at a rear terminal end thereof, including a battery housing lid, including a single or plurality of battery members 15. A switch member 16 is mounted in a side wall of the shoe sole 12 to accommodate shock and vibration and is operative through the battery members 15 to direct electrical energy to an associated vibratory housing device 17. The vibratory housing device 17 is coextensive With a vibratory communication member 18 coextensively directed to a top surface of the shoe sole 12 interiorly of the shoe upper 11. A first wire pair 19 is directed from the battery housing 13 to the switch member 16, with a second wire pair 20 directed from the switch member 16 to the vibratory housing device 17.

A vibratory plate 21 is positioned in contiguous and coextensive communication with a top surface of the vibratory housing device 17 and the vibratory communication member 18. This provides a continuous top surface to receive the replaceable polymeric shoe pad 22. The polymeric shoe pad 22 is formed of a plurality of such shoe pads defined by a first, second, third, fourth, and fifth respective pad 23, 24, 25, 26, and 27. The pads are utilized to direct various elements of vibratory energy and massaging to an individual's foot.

The first pad 23 includes a polymeric pad member formed with a plurality parallel malleable metallic rods 28 directed coextensively therethrough, With a matrix of hemispherical projections 29 mounted coextensively about a top surface of the first pad 23. The second pad 24 is of a like configuration, but utilizes a series o[parallel fluid filled tubular cavities 30. The fluid filled tubular cavities 30 dampen a portion of the vibratory energy directed to the second pad 24. In a like manner, the third pad 25 includes alternating metallic and fluid filled rods 28 and 30.

Figure 8:
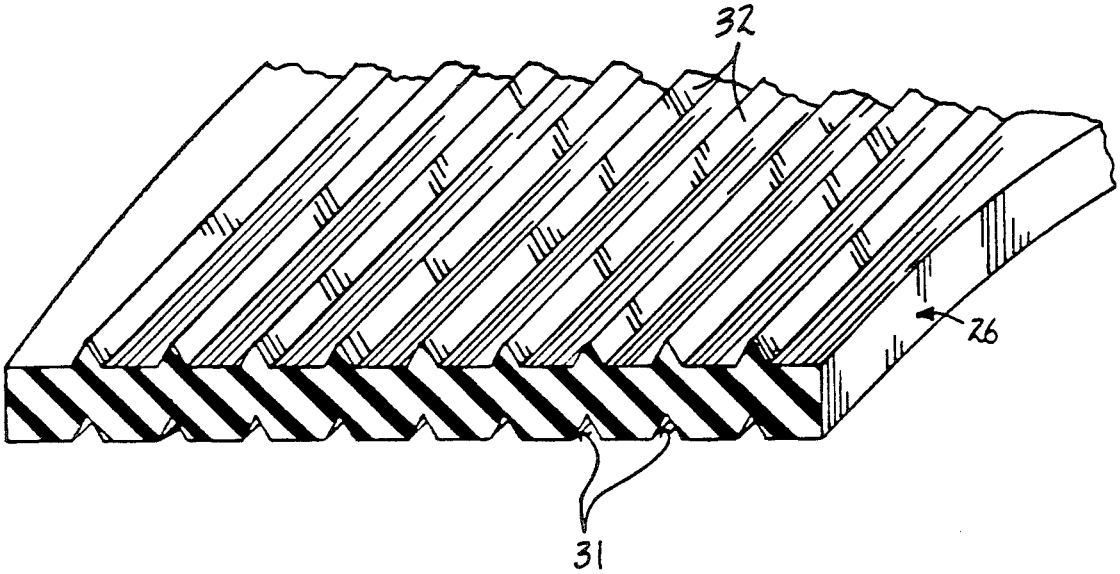
Figure 9:
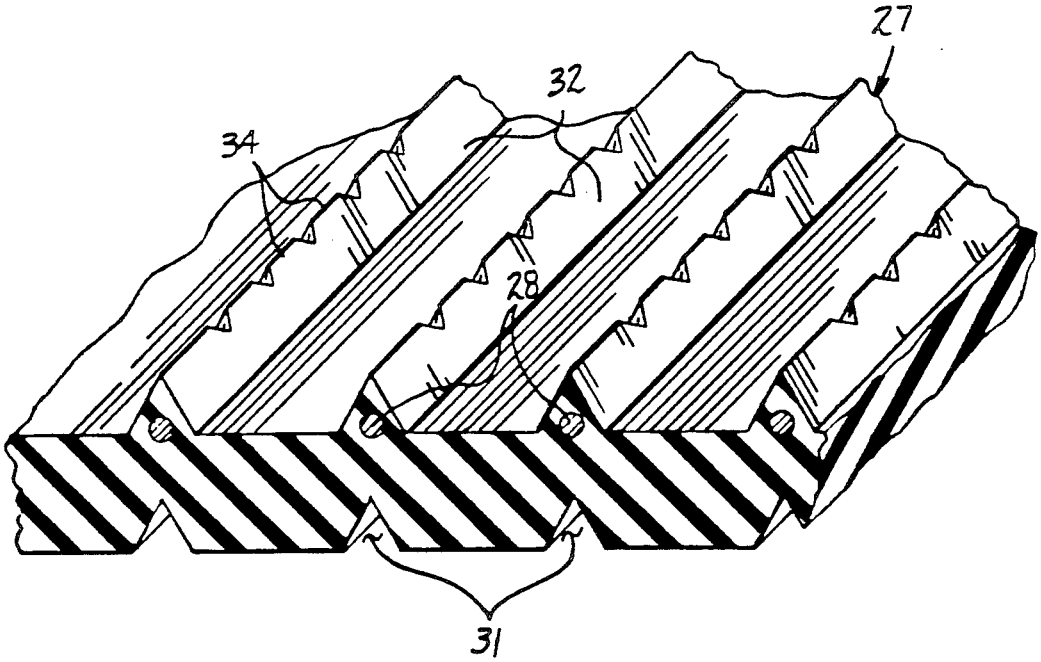

The fourth pad construction 26, as illustrated in FIG. 8, utilizes the same base flexible polymeric member formed with parallel "V" shaped grooves 31 directed through a bottom surface thereof, and projecting parallel "V" shaped ribs 32 to a top surface of the fourth pad 26. The fifth pad 2 includes metallic rods 28 directed coextensively through each of the parallel "V" shaped ribs 32, wherein each of the "V" shaped ribs 32 further include projections 34 defined between "V" shaped notches that are directed orthogonally through each upper terminal end or tip of the ribs 32 to enhance vibratory energy directed to the bottom of an individual's foot. The spaced projections enhance energy directed to individual portions of an individual's bottom surface of the foot in lieu of the continuous application of energy directed by the "V" shaped ribs themselves, as set forth in FIG. 8. The semi-spherical projections are utilized to provide application of such energy over larger areas of the foot and avoid localized application of vibratory energy, as produced by the "V" shaped rib members of the fourth and fifth pads 26 and 27.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A massaging shoe apparatus, comprising, a shoe upper, the shoe upper mounted coextensively to a shoe sole, and a battery housing mounted to a rear terminal end of the shoe upper, the battery housing including a lid, and including at least one battery member mounted within the battery housing, and a switch member mounted within the shoe sole, and the shoe sole formed of a flexible polymeric material to accommodate vibration and shock, and a vibratory housing device mounted contiguous to and above the shoe sole within the shoe upper, and the switch member in electrical communication between the battery housing and the vibratory housing device to effect selective actuation of the vibratory housing device, and further including a vibratory communication member mounted coextensively with the vibratory housing device in contiguous communication with the shoe sole, wherein the shoe sole is defined by a predetermined interior length interiorly of the shoe upper, and the vibratory housing device with the vibratory communication member positioned adjacent the vibratory housing device defining a predetermined length equal to the predetermined interior length, and including a vibratory plate mounted contiguous to and coextensively with the vibratory housing device and vibratory communication member and positioned above the vibratory housing device and vibratory communication member, and further including a plurality of polymeric sole pads, with at least one pad mounted within the shoe upper to coextensively overlie the vibratory plate, and wherein each of said polymeric pads includes a first pad, the first pad including a memory retentent polymeric pad member, including a plurality of parallel rods directed coextensively through the pad member longitudinally of the shoe sole, and further including a matrix of hemispherical projections mounted coextensively to a top surface of the first pad, and a second pad of the plurality of polymeric sole pads including a flexible memory retentent pad member with a plurality of parallel fluid filled tubular cavities directed through the pad member and a matrix of hemispherical projections mounted coextensively to a top surface of the pad member, and a third pad of the plurality of polymeric sole pads including a flexible polymeric pad member including a matrix of hemispherical projections mounted to a top surface of the pad with alternating metallic and fluid filled members directed coextensively and longitudinally of the third pad, and including a fourth pad, wherein the fourth pad includes a flexible polymeric pad member, the flexible polymeric pad member including a bottom surface, the bottom surface including a series of spaced parallel "V" shaped grooves, and the pad member top surface including a plurality of "V" shaped ribs arranged parallel relative to one another, and including a fifth pad, wherein the fifth pad includes a flexible polymeric pad member formed of memory retentent material, including a plurality of "V" shaped grooves directed through a bottom surface of the fifth pad member, and a plurality of parallel further "V" shaped ribs mounted to a top surface of the fifth pad, wherein the further ribs include "V" shaped ribs defining projections between the notches to enhance vibratory actuation of discrete portions of a foot.

* * * * *